US007464492B2

(12) United States Patent
Marechal et al.

(10) Patent No.: US 7,464,492 B2
(45) Date of Patent: Dec. 16, 2008

(54) ROLLER SKATE

(75) Inventors: Laurent Marechal, Villaz (FR); Pierre Alexis Marechal, Annecy (FR); René Borel, Saint-Sylvestre (FR); Louis Cabanis, Rumilly (FR)

(73) Assignee: Salomon S.A., Metz-Tessy (FR)

( * ) Notice: Subject to any disclaimer, the term of this patent is extended or adjusted under 35 U.S.C. 154(b) by 396 days.

(21) Appl. No.: 11/185,674

(22) Filed: Jul. 21, 2005

(65) Prior Publication Data

US 2006/0017242 A1 Jan. 26, 2006

(30) Foreign Application Priority Data

Jul. 22, 2004 (FR) ..... 04 08130

(51) Int. Cl.
*A43B 5/16* (2006.01)
*A43B 7/08* (2006.01)

(52) U.S. Cl. ..... 36/115; 36/50.5

(58) Field of Classification Search ..... 36/50.1, 36/50.5, 115, 117.1, 54
See application file for complete search history.

(56) References Cited

U.S. PATENT DOCUMENTS

| | | | | | |
|---|---|---|---|---|---|
| 3,993,318 | A | | 11/1976 | Rothmayer | |
| 4,072,317 | A | | 2/1978 | Pommerening | |
| 4,130,949 | A | * | 12/1978 | Seidel | 36/50.1 |
| 4,979,760 | A | * | 12/1990 | Derrah | 280/607 |
| 5,331,752 | A | | 7/1994 | Johnson et al. | |
| 5,357,695 | A | * | 10/1994 | Lu | 36/115 |
| 5,416,987 | A | * | 5/1995 | Bemis et al. | 36/50.1 |
| 5,463,822 | A | * | 11/1995 | Miller | 36/50.1 |
| 5,502,902 | A | * | 4/1996 | Sussmann | 36/50.1 |
| 5,564,203 | A | * | 10/1996 | Morris | 36/50.1 |
| 5,570,522 | A | | 11/1996 | Olson et al. | |
| 5,737,854 | A | * | 4/1998 | Sussmann | 36/50.1 |
| 5,839,735 | A | | 11/1998 | Benoit | |
| 5,918,387 | A | * | 7/1999 | Emerson | 36/122 |
| 5,971,423 | A | | 10/1999 | Hansen et al. | |
| 6,056,300 | A | * | 5/2000 | Carpenter et al. | 280/14.22 |
| 6,148,546 | A | | 11/2000 | Demarchi | |
| 6,224,070 | B1 | * | 5/2001 | Carpenter et al. | 280/14.21 |
| 6,412,794 | B1 | * | 7/2002 | Phillips et al. | 280/14.22 |
| D499,460 | S | | 12/2004 | Sirvain | |
| 2003/0205871 | A1 | | 11/2003 | Coburn et al. | |

(Continued)

FOREIGN PATENT DOCUMENTS

| | | | |
|---|---|---|---|
| DE | 92 08 063 | U1 | 10/1992 |

(Continued)

*Primary Examiner*—Marie Patterson
(74) *Attorney, Agent, or Firm*—Greenblum & Bernstein, P.L.C.

(57) ABSTRACT

A roller skate including a frame provided to receive a plurality of wheels; a sole adapted to support the user's shod foot; a heel stiffener; a foot retaining arrangement, capable of being in an open state, which enables insertion of the user's foot and, in a closed state, enables adjustment of the foot retaining arrangement around the user's foot, the foot retaining arrangement including: a forefoot anchoring, an instep anchoring, the forefoot and instep anchorings each having a pivot zone about which the foot retaining arrangement pivots when it is moved between the open and closed states; a forefoot fastening device, an instep fastening device adapted to keep the retaining arrangement in the closed state; and an adjustment mechanism enabling adjustment of the retaining arrangement to the morphology of the user's foot.

13 Claims, 12 Drawing Sheets

U.S. PATENT DOCUMENTS

| | | | | |
|---|---|---|---|---|
| 2004/0239057 | A1 | 12/2004 | Borel et al. | |
| 2006/0000116 | A1 * | 1/2006 | Brewer | 36/50.1 |
| 2007/0011913 | A1 * | 1/2007 | Holzer et al. | 36/50.1 |

FOREIGN PATENT DOCUMENTS

| | | | |
|---|---|---|---|
| EP | 0 551 704 | A2 | 7/1993 |
| EP | 0 846 480 | A2 | 6/1998 |
| EP | 1 484 092 | A1 | 12/2004 |
| FR | 2 839 264 | B1 | 11/2003 |
| WO | WO 03/099396 | A1 | 12/2003 |

* cited by examiner

PRIOR ART 35
10
18
18
14
15
13
22
12
36

ROLLER SKATE

CROSS-REFERENCE TO RELATED APPLICATION

This application is based upon French Patent Application No. 04 08130, filed on Jul. 22, 2004, the disclosure of which is hereby incorporated by reference thereto in its entirety and the priority of which is hereby claimed under 35 U.S.C. 119.

BACKGROUND OF THE INVENTION

1. Field of the Invention

The present invention relates to roller skates adapted to receive the user's shod foot, that is, the user uses the skate with a shoe that is independent of the skate.

2. Description of Background and Relevant Information

Skates are known from the prior art, in which the user inserts his/her foot directly into the fitting portion of the skate, which portion can be provided with a removable comfort element, or it can itself be sufficiently flexible and comfortable so as to be capable of receiving the user's foot. Such skates are not very practical for traveling about streets, such as for providing a means of "urban transportation", because, when done skating, the user cannot walk while wearing the skates. In practice, the user must always carry an additional pair of shoes in a bag when skating. Moreover, after skating and while walking, the user must carry the skates, which are relatively heavy and bulky.

Also known are skates of the "step-in" type, which include a walking shoe under which it is possible to fix a chassis equipped with wheels. Although these skates reduce the bulk that the user must carry while walking, they are not entirely satisfactory because, as walking shoes, they are not very comfortable. Indeed, in order for such a skate to function properly, the sole must be very rigid and the shoe upper must ensure a very firm rear support.

European Patent Application EP 551 704 and U.S. Pat. No. 5,331,752 disclose an in-line roller skate including a rigid frame, in which the user inserts an independent, detachable flexible shoe that makes it possible to walk. This system has the drawback that only a shoe specifically dedicated to the skate frame can be used, because various nesting structures are provided at the tip of the shoe and beneath the sole. Furthermore, the user is not properly held in such a skate.

U.S. Pat. No. 5,971,423 discloses a skate provided to receive an independent, detachable shoe. The means for retaining such a shoe is therein constituted by an instep element capable of pivoting about a transverse axis that is positioned in the area of the forefoot. Such a system does not give the user complete satisfaction because the foot insertion is difficult and not very intuitive. Moreover, this skate is bulky, and therefore not very practical for traveling about the streets as a means of "urban transportation".

German Design Patent Application DE 92 08 063 also describes a skate provided to receive an Independent shoe, and which includes a rigid frame equipped with a forefoot tightening means, an instep tightening means, and a lower leg tightening means. In addition to being bulky, such a skate, when not in use, has the drawback of being difficult to put on, because the user must space apart the extensions of the shell that carry the tightening means.

SUMMARY OF THE INVENTION

An object of the invention is to overcome the drawbacks of the prior art and, in particular, to provide a skate for which foot insertion is simple and intuitive.

Another object of the invention is a skate that is improved for traveling about the streets, i.e., for use as a means for "urban transportation" or commuting, and, in particular, a skate that can be easily stored after skating.

Yet another object of the invention is a comfortable and efficient skate that can be used with any low-upper shoe, i.e., a shoe that is independent and detachable of the skate, particularly a shoe having an upper edge that is located below the area of the ankle, even a shoe that is not specifically designed for use with a skate.

The objects of the invention are attained by the provision of a skate according to the claims below.

For example, a skate according to the invention can include the following:

- a chassis provided to receive a gliding member, such as a plurality of wheels or a blade for ice;
- a sole adapted to support the user's shod foot;
- a heel stiffener;
- a foot retaining arrangement, capable of being in an open state, which enables insertion of the user's foot and, in a closed state, enables adjustment of the foot retaining arrangement around the user's foot, the foot retaining arrangement including the following:
  - medial and lateral anchoring mechanisms, each having a pivot zone about which the foot retaining arrangement pivots when it switches from the open state to the closed state;
  - medial and lateral fastening devices adapted to keep the retaining arrangement in the closed state;
  - adjustment device enabling adjustment of the retaining arrangement to the morphology of the user's foot.

The anchoring mechanisms correspond to mechanisms for fixing the retaining arrangement to the remainder of the skate, which, although it can be detachable, for an adjustment, for example, it is not provided to be detached for each use of the skate, i.e., each time that the user inserts or removes his/her foot from the skate. The fastening devices correspond to devices for fixing the retaining arrangement to the remainder of the skate, which is necessarily and simply detachable. During daily use of the skate, only the fastening devices would typically be opened/detached.

According to the invention, the retaining arrangement can tilt along a substantially longitudinal axis so as not to hinder foot/shoe insertion in the open position. This tilting occurs on the lateral side if the anchoring mechanisms are positioned on the lateral side, and on the medial side if they are positioned on the medial side.

Objects of the invention are also achieved by the provision of a roller skate including that includes the following: a frame provided to receive a plurality of wheels; a sole adapted to support the user's shod foot; a heel stiffener; a foot retaining arrangement, capable of being in an open state, which enables insertion of the user's foot and, in a closed state, enables adjustment of the foot retaining arrangement around the user's foot, the foot retaining arrangement including the following: a forefoot anchoring, an instep anchoring, the forefoot and instep anchorings each having a pivot zone about which the foot retaining arrangement pivots when it moves between the open and closed states, a forefoot fastening device, an instep fastening device adapted to keep the retaining arrangement in the closed state; an adjustment device enabling adjustment of the retaining arrangement to the morphology of the user's foot.

The pivot zones of the forefoot and instep anchorings provide a tilting amplitude for the retaining arrangement such that, in the open state, the retaining arrangement is completely outside of the user's shod foot access area. Thus, the skate according to the invention is much easier to put on and much easier to take off.

The user inserts his/her shod foot directly into the skate, that is, the user would have already put on his/her walking shoe before positioning the foot, and the shoe, on the skate sole.

In a first embodiment of the invention, the retaining arrangement has a cover including a forefoot pad and an instep pad, with a band connecting the pads to one another. In a particular variation, the instep fastening device includes a notched strap and a lever ratchet mechanism, and the adjustment device includes a flexible strap that runs over the foot retaining arrangement along a Z-shaped path.

In a second embodiment of the invention, the retaining arrangement has a cover including a lateral pad and a medial pad connected to one another by an adjustment device enabling adjustment of the retaining arrangement to the user's morphology. In a particular variation, the adjustment device includes a lacing assembly equipped with a plurality of guides/keepers and a lace.

In a third embodiment, the medial and lateral anchoring mechanisms, respectively, include a first material panel capable of being folded along an axis that is substantially parallel to the longitudinal axis of the skate, the lateral and medial fastening devices, respectively, including a second panel equipped with at least one connection, the retaining arrangement including a central portion provided to be inserted between the first panel and the second panel, the second panel and the first panel being fixed to one another by self-adhesive bands, i.e., such as bands having respective hook-and-loop fastening surfaces.

In a particular variation, the foot retaining arrangement includes a tongue that extends up to the upper end of the skate, or approximately thereto or beyond, and which ensures a continuity of comfort in the area of the user's lower leg.

BRIEF DESCRIPTION OF DRAWINGS

The invention will be better understood and other characteristics thereof will become apparent from the following description, with reference to the attached drawings, in which.

DETAILED DESCRIPTION OF THE INVENTION

Figure 1:
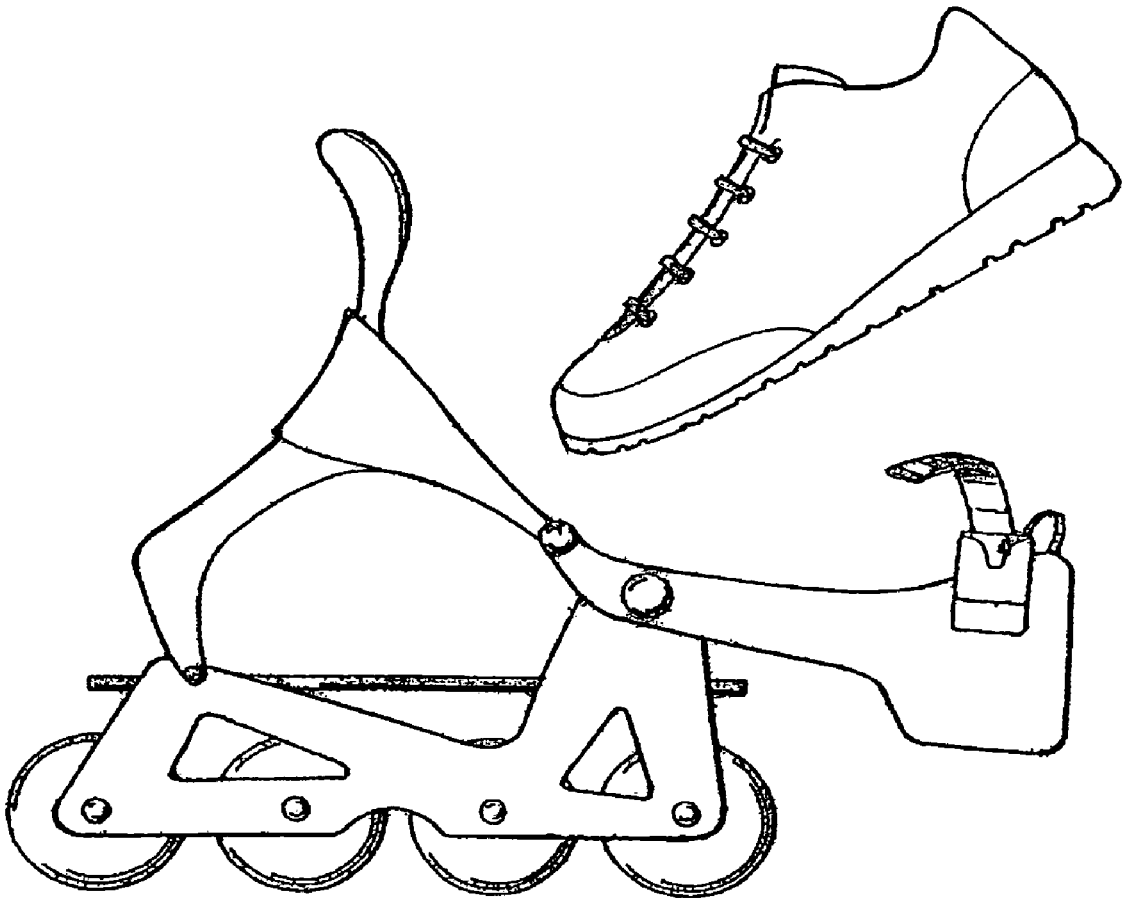
FIG. 1 describes a first skate according to the prior art.

FIG. 1 illustrates a first skate adapted to receive an independent and detachable shoe according to the prior art. It includes an instep element articulated with respect to the front of the skate and with respect to the collar. In order to insert the foot, the user tilts the collar rearward, which causes the forward tilting of the instep element. In addition to not being intuitive, the functioning of such a skate requires a certain rigidity in its constituent elements. This is particularly the case of the instep element which, as a result, does not permit an accurate adjustment to the morphology of the user's foot.

Figure 2:
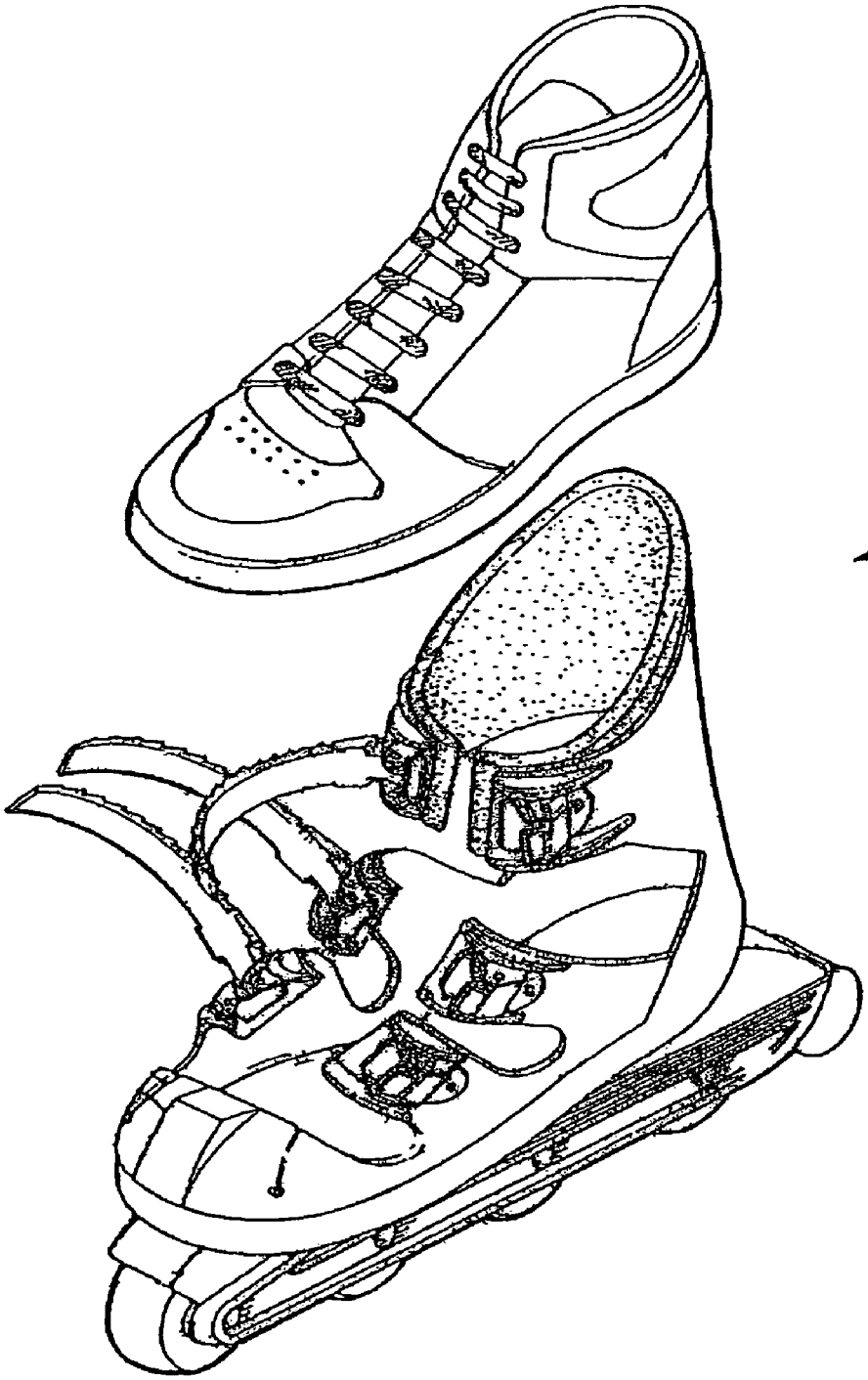
Fig: 2 PRIOR ART
FIG. 2 describes a second skate according to the prior art.

FIG. 2 illustrates a second skate adapted to receive an independent and detachable shoe according to the prior art. In this skate, means for adjusting the skate to the forefoot and to the instep are fixed at the ends of extensions coming from the skate sole. These extensions are made of a rigid plastic material. Although the use of such a skate might be more intuitive than that of the skate shown in FIG. 1, it is not easy to put on and to take off, because the rigid extensions remain practically immovable and block the shoe access area in the skate. In practice, the user must space the extensions apart with his/her hands in order to insert the foot, shod with the independent shoe, in the skate.

Figure 3:
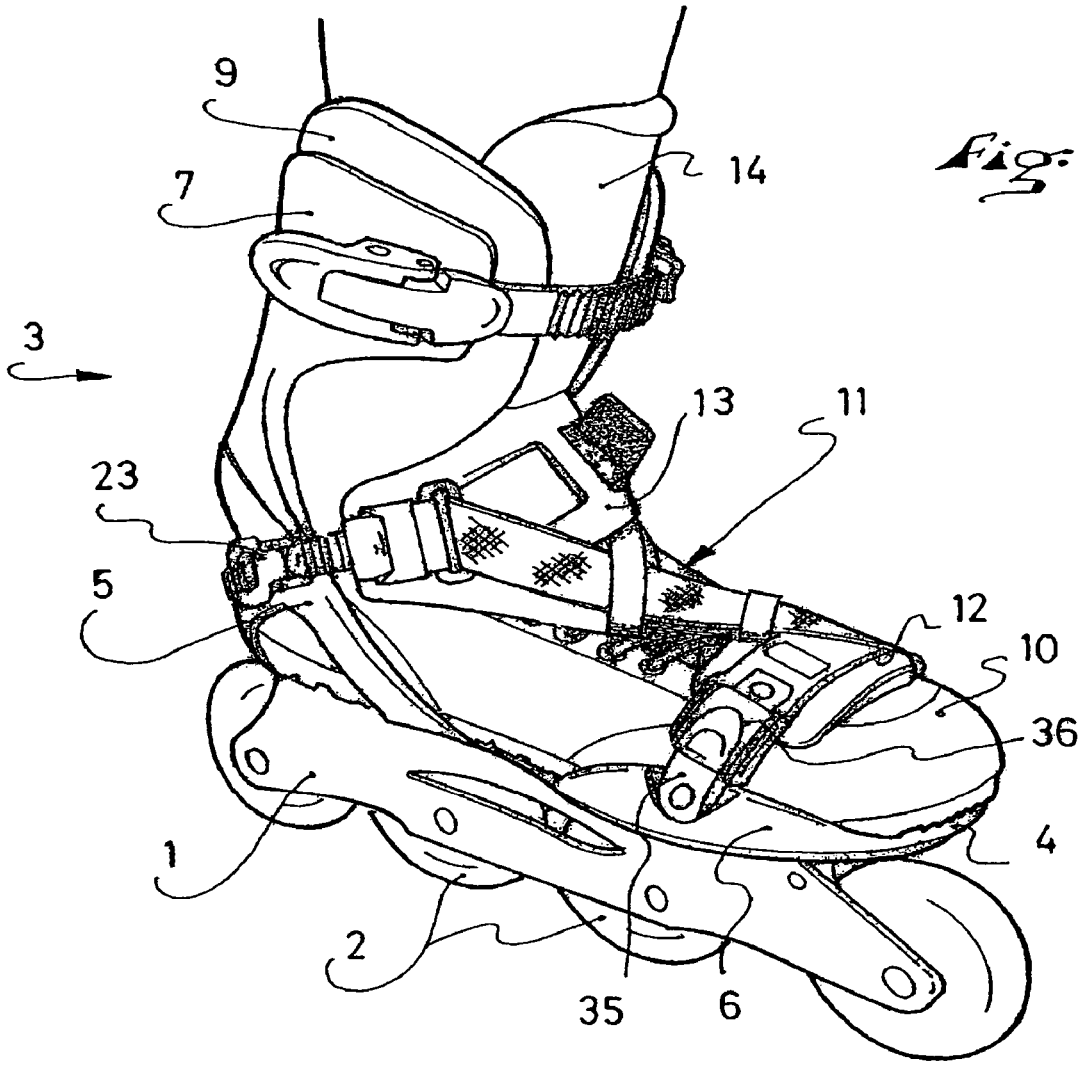
FIG. 3 is a perspective view of a skate according to a first embodiment of the invention.

FIG. 3 illustrates an in-line roller skate 3 according to a first embodiment of the invention. It includes a frame 1, or chassis, between the sides of which four inline wheels 2 are mounted. The fitting portion of the skate 3 includes a sole 4 adapted to support the user's shoe 10 that is detachable from the skate. A heel stiffener 5 rises from the rear portion of the sole 4, whereas vertical edges 6 extend from the front portion of the sole 4. The sole 4, stiffener 5, and edges 6 can be made in a single piece by injection molding of a plastic material. Making this element in a single piece is only an alternative, and one can envision making these components separately, which would then be affixed to one another by any known means. The fitting portion 3 also includes a collar 7 fixed on the stiffener 5 by two rivets 8 (see FIG. 6). This particular attachment enables the collar to pivot about the axis constituted by the two rivets, or approximately constituted thereby, which rivets are positioned substantially in the area of the malleolus of the foot when positioned within the skate. The forward tilting of the collar makes it possible to collapse the collar 7 when the skate is not in use, thus reducing the volume that it occupies. The collar 7 is fitted with a comfort pad 9, or liner, in the illustrated embodiment. The collar also has a lower leg tightening device including a notched strap that is positioned on a lever and is adapted to cooperate with a ratchet mechanism. In alternative embodiments, the collar cannot pivot with respect to the stiffener; these two components can even be made in a single unitary element.

The fitting portion 3 receives the user's shoe 10. The shoe 10 is a low-upper shoe, that is, a shoe in which the upper does not extend up to the zone of the user's lower leg, but typically has an upper edge that is positioned beneath the area of the user's ankle. The shoe is retained in the skate fitting portion by a retaining arrangement in the form of a cover 11. The cover 11 includes a forefoot pad 12, an instep pad 13, a tongue 14, as well as an adjustment device for adjusting the cover to the morphology of the user's foot/shoe in the area of the forefoot and the area of the instep. The forefoot and instep pads as well as the tongue 14 include an assembly of various elements, including comfort elements made, for example, of foam or non-woven textile materials, and structural elements made of materials having a greater tensile strength than that of the comfort elements. Among other things, the forefoot and instep pads have a function of distributing the forces exerted by the adjustment device on the cover 11 and, therefore, on the user's foot/shoe.

Figure 5:
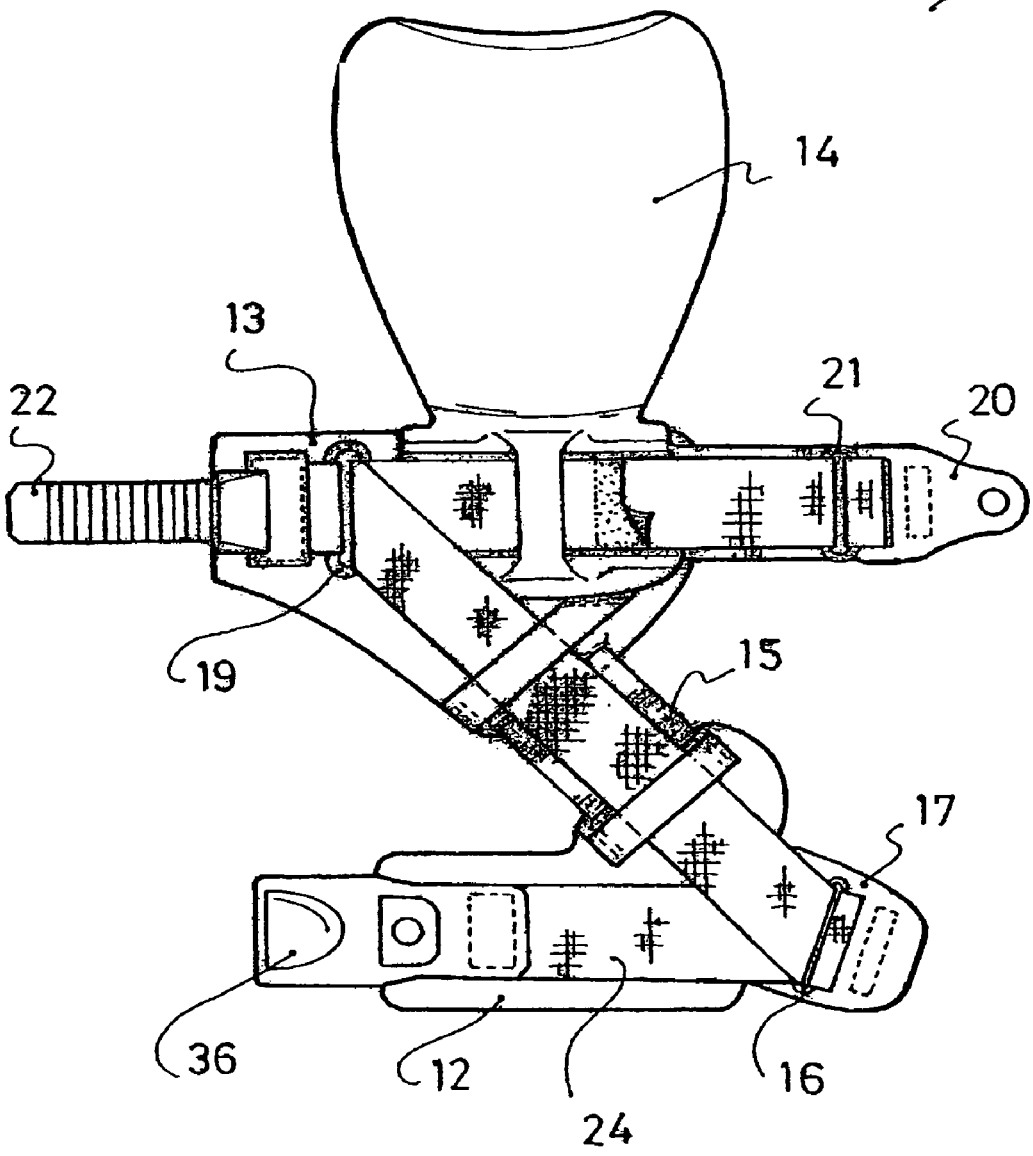
FIG. 5 is a top view of the cover of the skate of FIG. 3.

FIG. 5 shows a top view of the cover detached from the remainder of the skate. A band 15 connects the forefoot pad 12 and the instep pad 13 to one another. The orientation of the band 15, with respect to the two pads, provides the cover with a Z-shaped contour. The band 15 is more flexible than the forefoot and instep pads so as to enable accurate adjustment of the cover 11 to the user's morphology. Nevertheless, it is sufficiently rigid to ensure a certain retention of the cover 11, particularly so that, when the user pivots the cover 11 by maneuvering the notched strap 22, the forefoot pad 12 also follows the pivoting movement, as if the latter were rigidly connected to the remainder of the cover 11, and so that the male and female portions of the forefoot fastening device find themselves facing each other directly.

The lateral side of the forefoot pad 12 includes the female portion of the forefoot fastening device. This female portion includes a ratchet 36. The male portion of this same fastening device includes a tongue 35 that is fixed on the lateral edge 6 extending from the sole 4. A flexible strap 24 is sewn, or otherwise fixed, on the forefoot pad 12 in the vicinity of the lateral side thereof. It runs along the largest portion of the forefoot pad, up to its medial side. To keep the strap in position with respect to the pad, one or several keepers, or guides, can be positioned on the top of the forefoot pad. The flexible strap 24 passes through a forefoot loop 16 that is fixed to a forefoot flange 17. The forefoot flange 17 is fixed by any known means on the medial edge 6 extending from the sole 4. The forefoot flange 17 and the forefoot loop 16 comprise the forefoot anchoring of the cover 11.

FIG. 5 shows that, once the flexible strap 24 has passed through the forefoot loop 16, it joins the lateral side of the instep pad 13, along a diagonal path, by passing over the band 15 connecting the two pads. It passes again in a loop, the lateral loop 19, then extends along the top of the instep pad 13, up to the medial side thereof. An instep flange 20, provided to be attached to the stiffener 7, is equipped with a medial loop 21. The strap passes through the medial loop 21 and is then folded over itself and is retained by means of a self-adhesive mechanism, such as complementary hook-and-loop fastening surfaces (such as Velcro® bands, for example), or a snap fastening mechanism, for example. The instep flange 20 and the instep loop 21 comprise the instep anchoring of the cover 11.

The lateral loop 19 is fixed at the end of a notched strap provided to be received in a lever ratchet mechanism 23 (see FIG. 3) attached on the lateral side of the stiffener. The lateral loop 19 and the notched strap are also fixed with respect to the instep pad 13.

The cover 11 also includes a tongue 14 that is fixed on the instep pad 13 and extends up to the top of the fitting portion. The tongue 14 is positioned between the lateral and medial sides of the pad 9 with which the collar 7 is fitted, and makes it possible to ensure comfort continuity. An alternative embodiment of the invention involves eliminating this tongue so as to possibly use a pad 9 surrounding the entire, or almost the entire perimeter of the user's lower leg.

Figure 6:
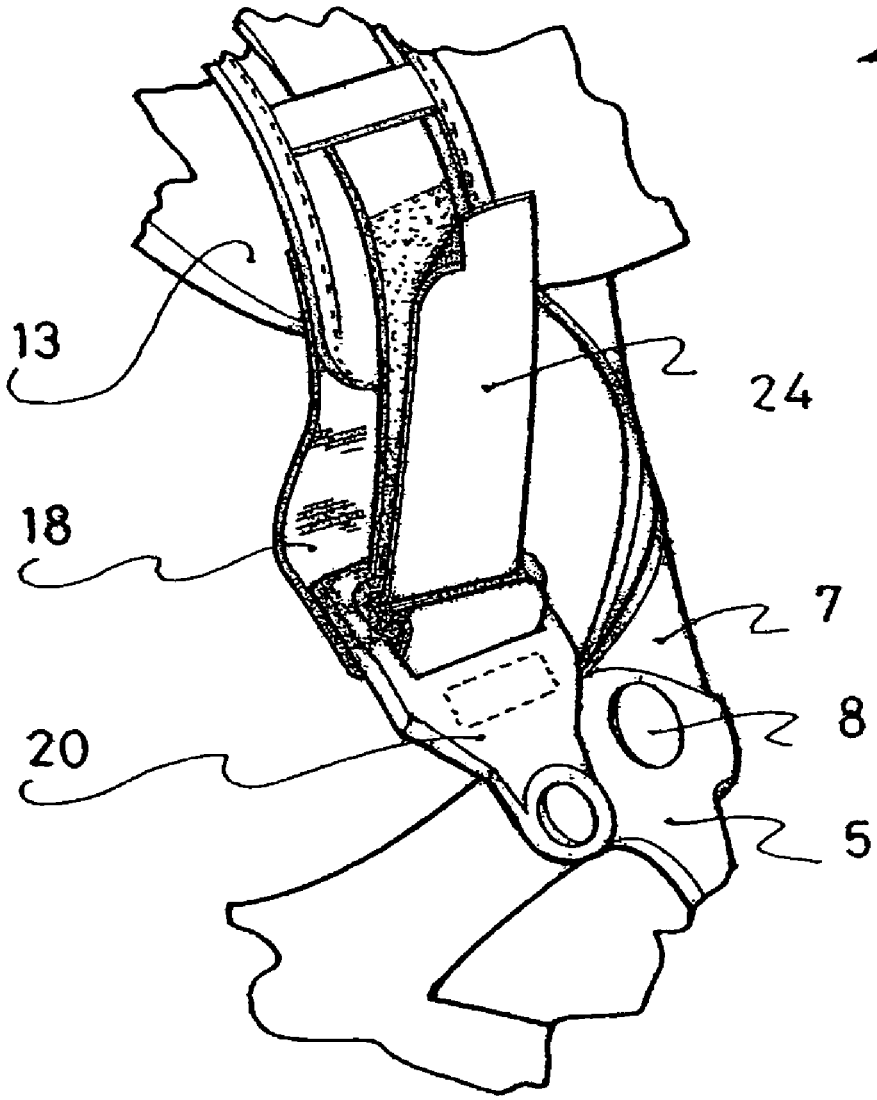
FIG. 6 is a detailed view of the instep pivot zone of the skate of FIG. 3.

FIG. 6 shows a partial view of the instep pivot zone constituted in the area of the instep loop 21. The instep pad 13 and the instep flange 20 are connected to one another, indirectly by means of the strap and of the instep loop, on the one hand, and directly by means of an elastic band 18 sewn onto each of the two components, or otherwise attached thereto, on the other hand.

A similar construction is provided in the area of the forefoot. In other words, an elastic band 18 connects the forefoot flange 17 to the forefoot pad 12.

Figure 4:
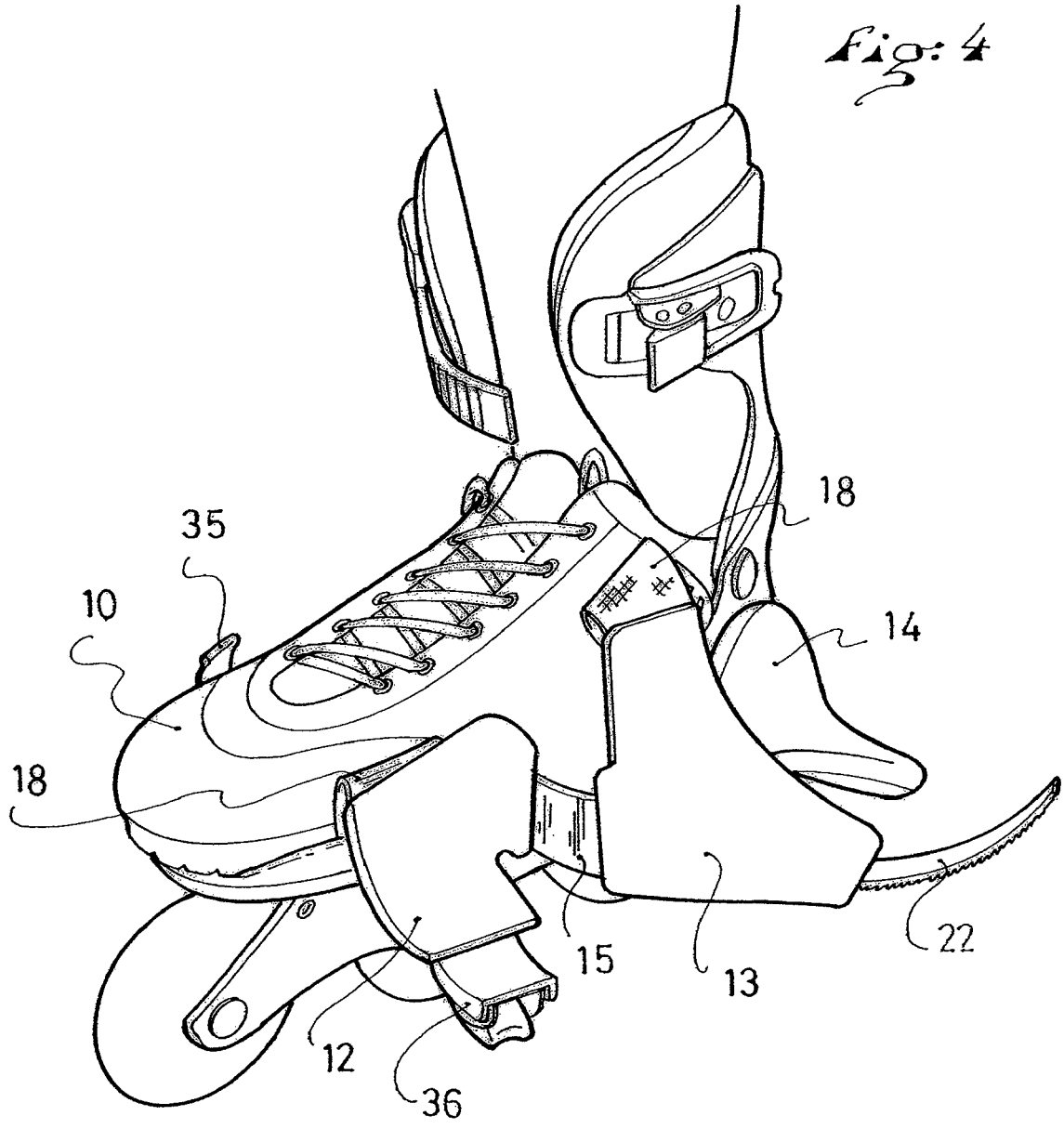
FIG. 4 is a perspective view of the skate of FIG. 3 in the open state.

FIG. 4 shows the skate according to the invention in the open state. After the user has inserted his/her shod foot therein, the forefoot flange 17 and the medial loop 21 play the role of a pivot that facilitates opening the cover 11 and keeping it in the open position. The amplitude of the tilting movement of the cover 11 is such that, in the open state, the latter is outside of the shod foot area of access to the skate sole.

The presence of the elastic bands connecting the forefoot pad 12 and the instep pad 14 to the forefoot flange 17 and the instep flange 20, respectively, facilitates the use of the skate, because they more accurately position the two pads in the open position as well as in the closed position.

Initially, the user only maneuvers the cover 11 in order to close the skate. For example, the user grabs the notched strap with his/her hand. Due to the semi-rigid connection between the two pads and the presence of the elastic bands, the assembly of the elements constituting the cover 11 pivots very easily until occupying the closed position.

Next, the user actuates the forefoot fastening device, which includes a mere ratchet with no possible adjustment. In fact, the forefoot adjustment device, which enables adaptation to the perimeter of the user's forefoot, is constituted by the sliding of the portion of the flexible strap that runs over the forefoot pad 12.

The positioning of the notched strap 22 in the lever ratchet mechanism 23 enables the user to adjustably adapt the skate to his/her foot. The notched strap 22, by means of the lateral loop 19, ensures the traction of the flexible strap in two directions.

Ultimately, the use of the skate is very simple and intuitive. In the open state, due to the forefoot 16 and medial 21 loops and to the pivoting amplitude that they provide for the cover 11, the cover is completely out of any possible path between the user's shod foot and the skate sole, that is, outside the shod foot area of access to the sole. Therefore, the user can position his/her foot and shoe on the skate sole in the most natural fashion. Then, the user only has to tilt the cover, as he/she would do with the door of an automobile.

Figure 7:
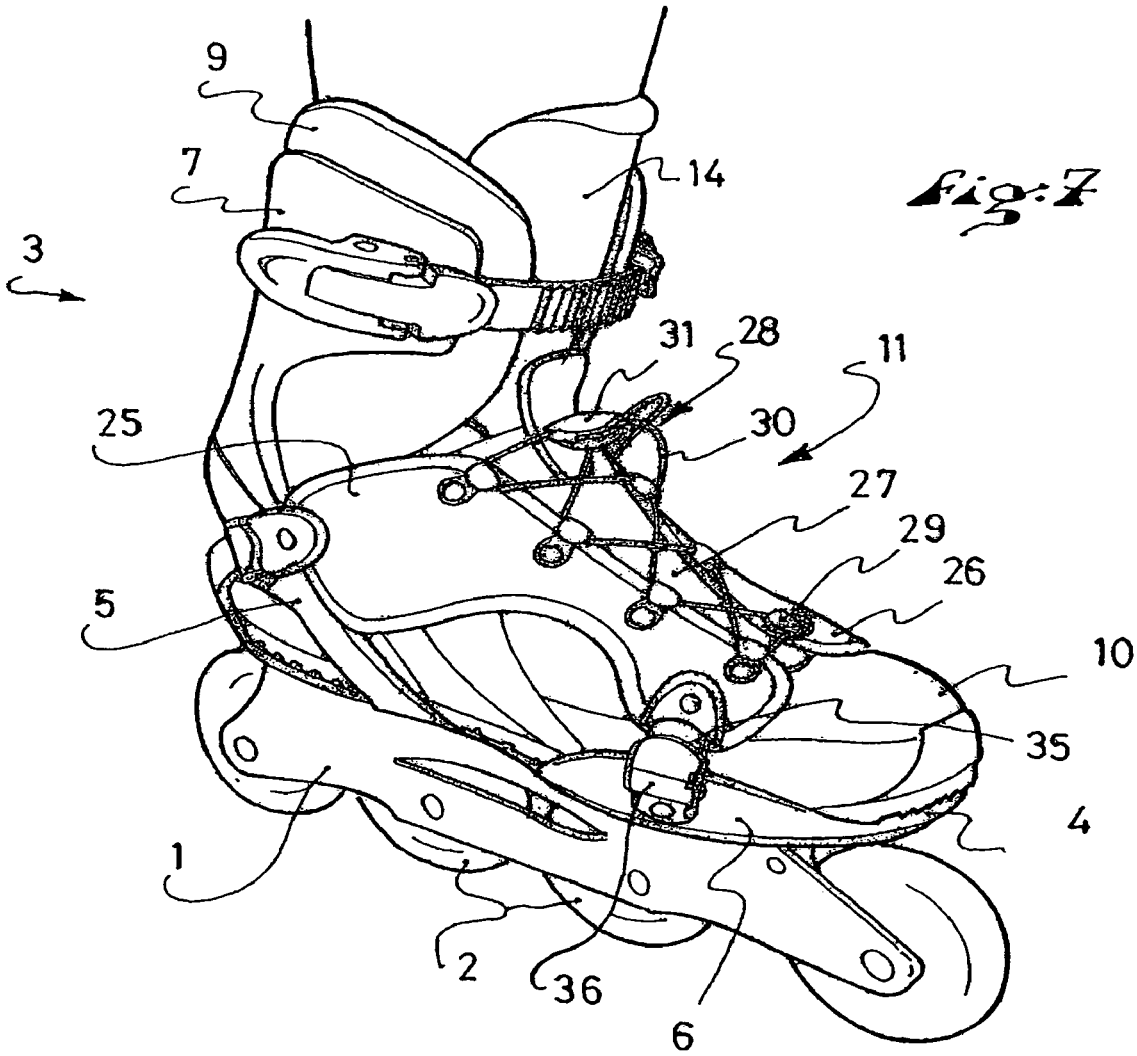
FIG. 7 is a perspective view of a skate according to a second embodiment of the invention.

FIG. 7 illustrates an in-line roller skate according to a second embodiment of the invention. It includes a frame 1, or chassis, between the flanges of which four inline wheels 2 are mounted. The fitting portion 3 includes a sole 4 adapted to support the user's shoe. A heel stiffener 5 rises from the rear portion of the sole 4, whereas edges 6 extend from the front portion of the sole 4. The fitting portion also includes a collar 7 that is fixed on the stiffener by two rivets 8. This attachment enables the collar to pivot about the axis constituted by the two rivets, which are positioned substantially in the area of the malleolus of the foot. The collar 7 is fitted with a comfort pad 9 or liner.

The fitting portion receives the user's shoe 10. This is a low-upper shoe, that is, a shoe in which the upper does not extend up to the zone of the user's lower leg. The shoe is retained in the skate fitting portion by the retaining arrangement that is in the form of a cover 11. The cover 11 includes a lateral pad 25, a medial pad 26, a tongue 14, as well as an adjustment device.

The medial pad 26 is fixed on the medial side of the skate by means of a forefoot anchoring mechanism and of an instep anchoring mechanism that are comprised by flexible straps in this embodiment. The medial pad 26 and the lateral pad 25 are connected to one another by means of an adjustment device. In the embodiment described, the adjustment device comprises a lacing assembly 28 that has a plurality of keepers 29, or guides, arranged on both sides of the lacing zone, on those of the sides of each of the two lateral and medial pads facing each other, as well a lace 30, the two strands of which pass alternately from the lateral pad to the medial pad and vice versa. The lacing assembly is equipped with a lace blocker 31 through which the two lace strands pass upon exiting from the lacing zone. The lateral pad and the medial pad are also connected to one another by a panel 27 made of an elastic material.

The adjustment device according to the invention is not necessarily a lacing or an assembly that includes a lacing. It is contemplated, according to the invention, that a strap can be used or any other device capable of adjusting the relative position of the medial pad 26 and of the lateral pad.

The male portions of the forefoot fastening device and of the instep fastening mechanism are fixed on the lateral pad 25 and are adapted to be received in corresponding female elements. The latter comprise mere ratchet mechanisms 36, whereas the male portions include a tongue 35 equipped with a tooth provided to cooperate with the ratchet. These fastening devices can be either engaged or disengaged, but they do not permit any adjustment. Other fastening devices can be used within the scope of the invention. For example, they can comprise the association of hooks provided on the lateral edges and the stiffener, on the one hand, and of loops fixed on the cover 11, on the other hand, i.e., in the form of hook-and-loop fastening mechanisms (such as Velcro® bands, for example).

The elastic panel 27 is positioned beneath the adjustment device and makes it possible, among other things, to avoid contact between the lacing assembly 28 of the skate and the tightening mechanism that might possibly be present on the user's shoe. The tongue 14 is fixed by sewing, for example, on the elastic panel 27.

Figure 8:
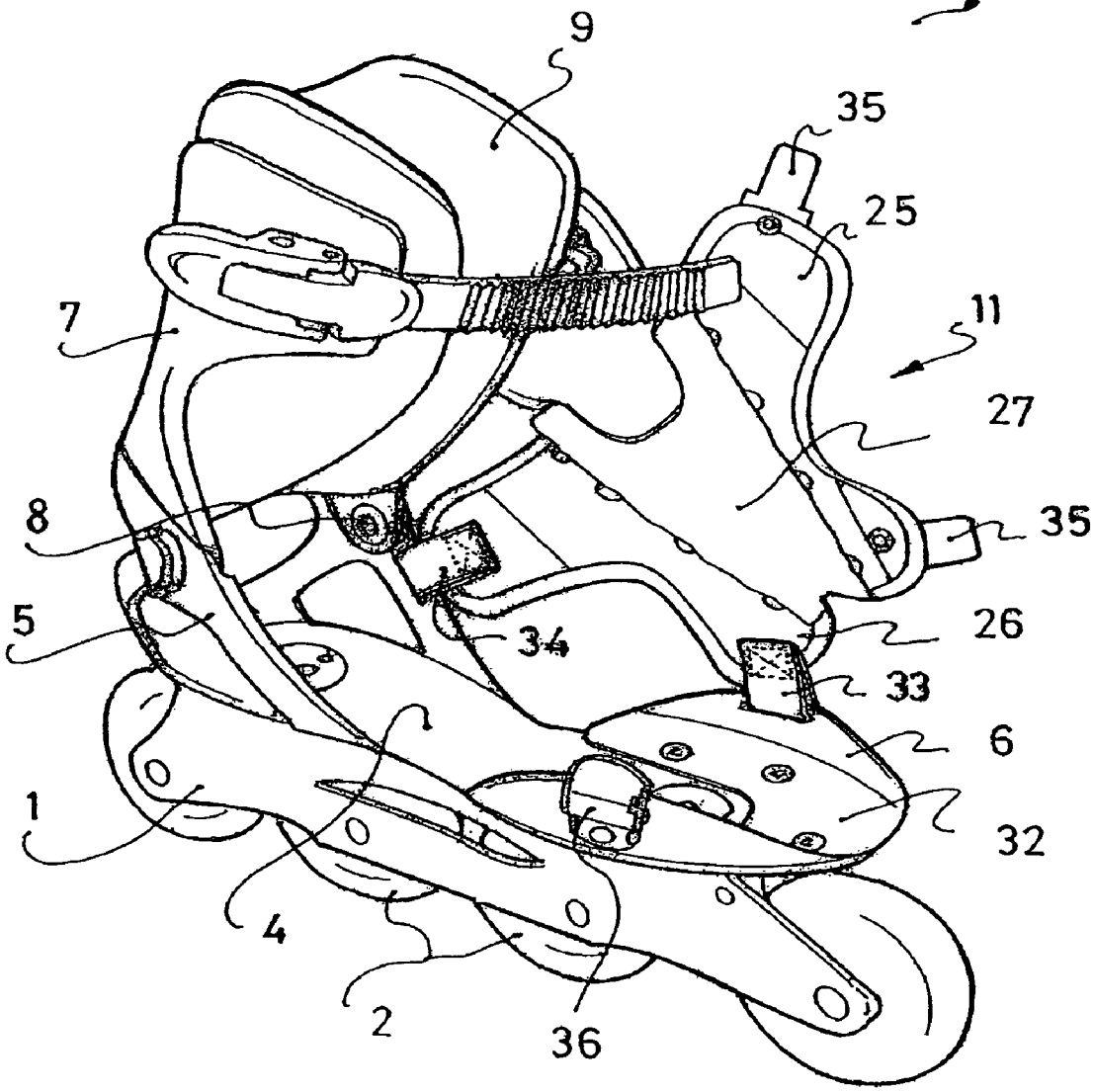
FIG. 8 is a perspective view of the skate of FIG. 7 in the open state.

FIG. 8 shows the skate according to the second embodiment of the invention in the open state. In this embodiment, the lateral and medial edges 6 are connected to an end-piece 32, which is fixed on the sole by a plurality of rivets (or other connectors). The forefoot anchoring mechanism and the instep anchoring mechanism include a forefoot strap 33 and an instep strap 34, respectively, which are made with straps that are more flexible than the lateral pad. As an example, the straps used are woven flexible straps that do not have longitudinal rigidity and, as a result, constitute a pivot zone about which the cover can tilt. Thus, in the open state, the cover can be placed completely out of the shod foot area of access to the skate sole.

The use of the skate according the second embodiment is simple and intuitive. The user puts the skate in the open position by tilting the cover 11. In the open state, the cover 11 can be positioned out of the shod foot area of access to the skate sole 4. Therefore, the user can simply and intuitively position his/her foot, already shod with the shoe, on the sole. Then, in a single operation, the user tilts the cover to the closed position. During this operation, the tongues 35 of the fastening devices are positioned in the ratchet mechanisms 36. A mere pressure makes it possible to engage them. Finally, a traction on the lace adjusts the cover to the user's morphology.

Figure 9:
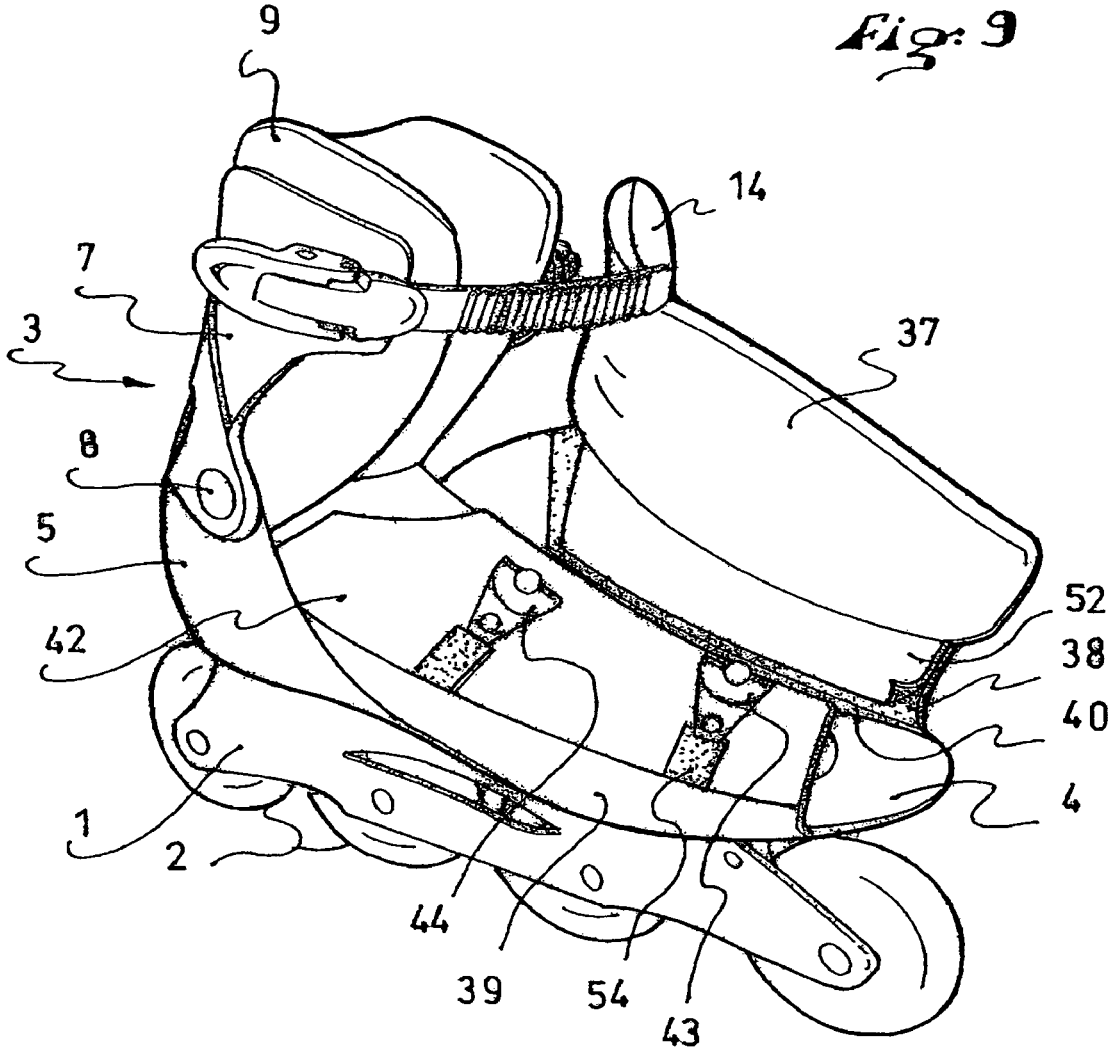
FIG. 9 is a perspective view of a skate according to a third embodiment of the invention, when the retaining arrangement is in the open state.

FIG. 9 illustrates a skate according to a third embodiment of the invention. It includes a chassis 1, or frame, between the flanges of which four inline wheels 2 are mounted. The fitting portion 3 includes a sole 4 adapted to support the user's shoe 10. A heel stiffener 5 rises from the rear portion of the sole 4. The sole 4 and the stiffener 5 can be made in a single unitary piece by injection molding of a plastic material. Making this element in a single piece is only an alterative, the invention encompassing producing these components separately, which would then be affixed to one another by any known means. A lateral edge 39 and a medial edge 40 are fixed on the lateral side and on the medial side respectively, of the sole 4. The fitting portion 3 also includes a collar 7 fixed on the stiffener by two rivets 8. This attachment enables the collar to pivot about the axis constituted by the two rivets, or approximately constituted thereby, which are positioned substantially in the area of the malleolus. The forward tilting of the collar makes it possible to collapse the collar 7 when the skate is not in use, thereby reducing the volume occupied by the skate. The collar 7 is fitted with a comfort pad 9 or liner. The collar also includes a lower leg tightening device having a notched strap positioned on a lever and adapted to cooperate with a ratchet. In alternative embodiments, the collar cannot pivot with respect to the stiffener; these two components can even be made as a single unitary element.

The fitting portion 3 receives the user's shoe, not shown in this drawing figure. As is the case with the previous embodiments, the shoe can be a low-upper shoe, i.e., a shoe in which the upper does not extend up to the zone of the user's lower leg.

The foot retaining arrangement is shown in FIG. 9 in the open position, i.e., so that it does not hinder the positioning of the shoe. It includes a central portion 37, or cover, which is anchored on the medial side of the skate by a medial anchoring mechanism that includes a first panel 38.

The first panel 38 is made in the form of an assembly of fabric and/or synthetic panels, and it is fixed by sewing to the medial edge 40, or fixed thereto by another known assembly method. The attachment by sewing of the first panel 38, which is flexible, to the medial edge 40, which is rigid, defines the pivot axis 41 of the medial anchoring mechanism. This axis is oriented along a direction that is substantially parallel to the longitudinal axis of the skate. The first panel also includes a plurality of keepers or guides used by the adjustment device for adjusting the retaining arrangement to the morphology of the user's foot.

Figure 10:
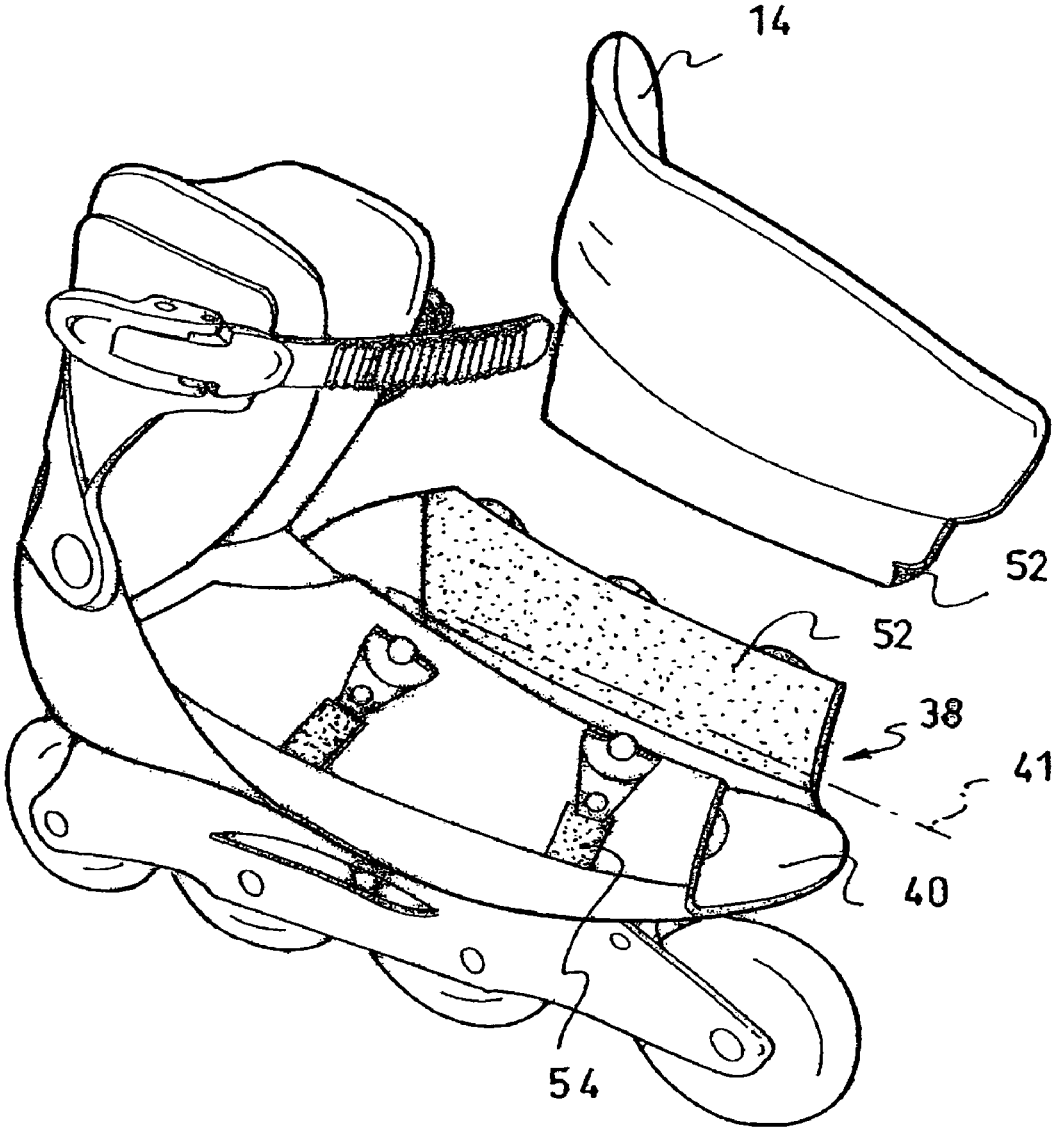
FIG. 10 is a view similar to FIG. 9, when the retaining arrangement is detached from the medial anchoring mechanism.

The central portion 37 is connected to the first panel 38 by means of self-adhesive bands 52, such as hook-and-loop connectors or Velcro® bands. As can be seen in FIG. 10, where the central portion 37 is shown detached from the medial anchoring mechanism, the self-adhesive bands 52 used are relatively wide so as to enable a relative positioning adjustment between the first panel and the central portion. Such an adjustment is a memorized adjustment, because the user does not have to modify it with each opening and closure of the skate.

The foot retaining arrangement includes a tongue 14 that extends up to the upper end of the skate or approximately thereto.

The lateral fastening device includes a second panel 42, fixed by sewing or other means of attachment on a lateral edge 39, on which two hooks, a forefoot hook 43 and an instep hook 44, are fixed.

Figure 11:
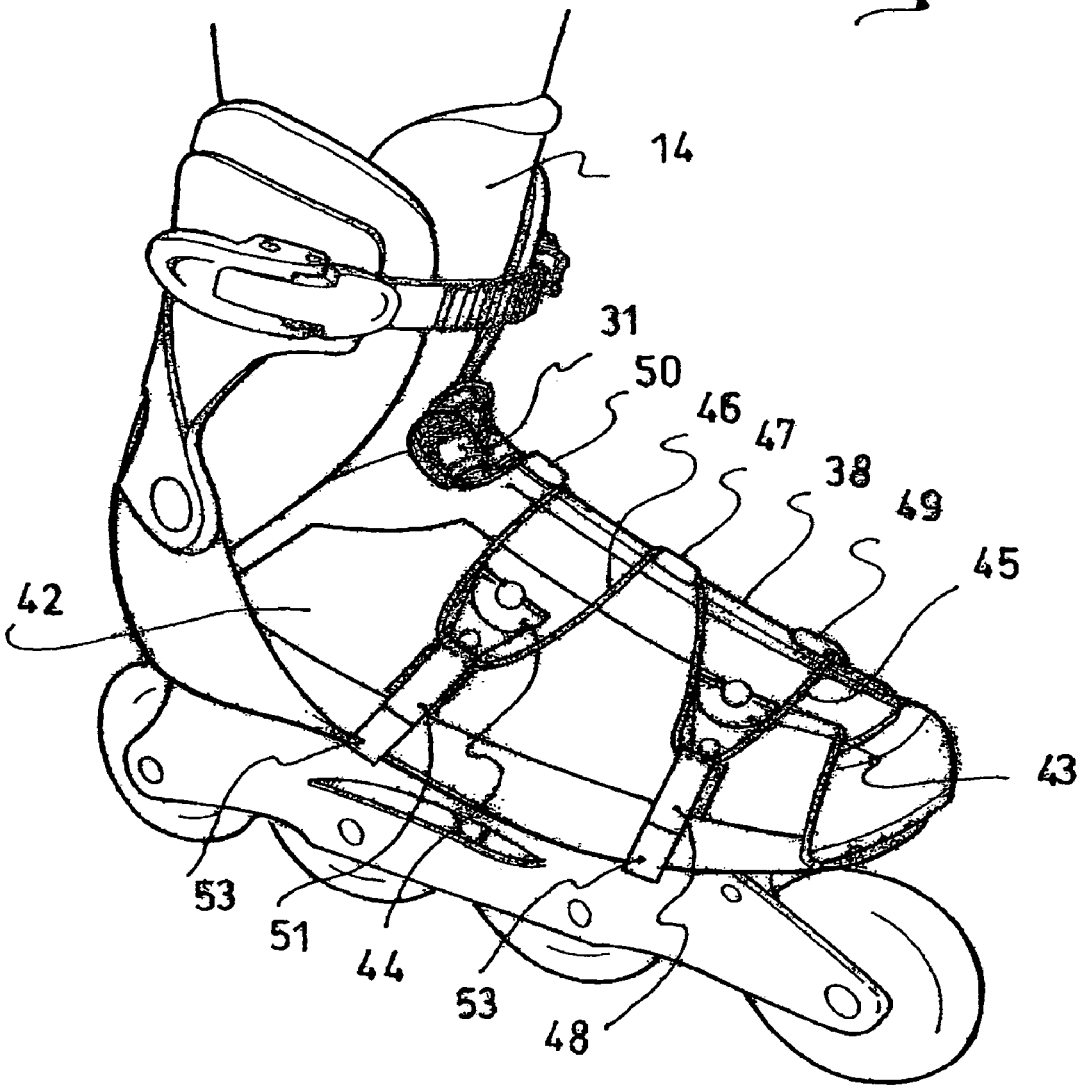
FIG. 11 is a perspective view of the skate according to the third embodiment of the invention, when the retaining arrangement is in the closed state.

FIG. 11 shows the skate according to the third embodiment of the invention in the closed position, before the tightening of the adjustment device enabling adjustment of the retaining arrangement to the user's morphology occurs, that is, before the manipulation member (shown in FIG. 12), on the side of the blocker 31 remote from the lacing zone, is pulled. The adjustment device can be seen in FIG. 11 to include a first lace strand, referred to as the forefoot lace 45, and a second lace strand, referred to as the instep lace 46.

Figure 12:
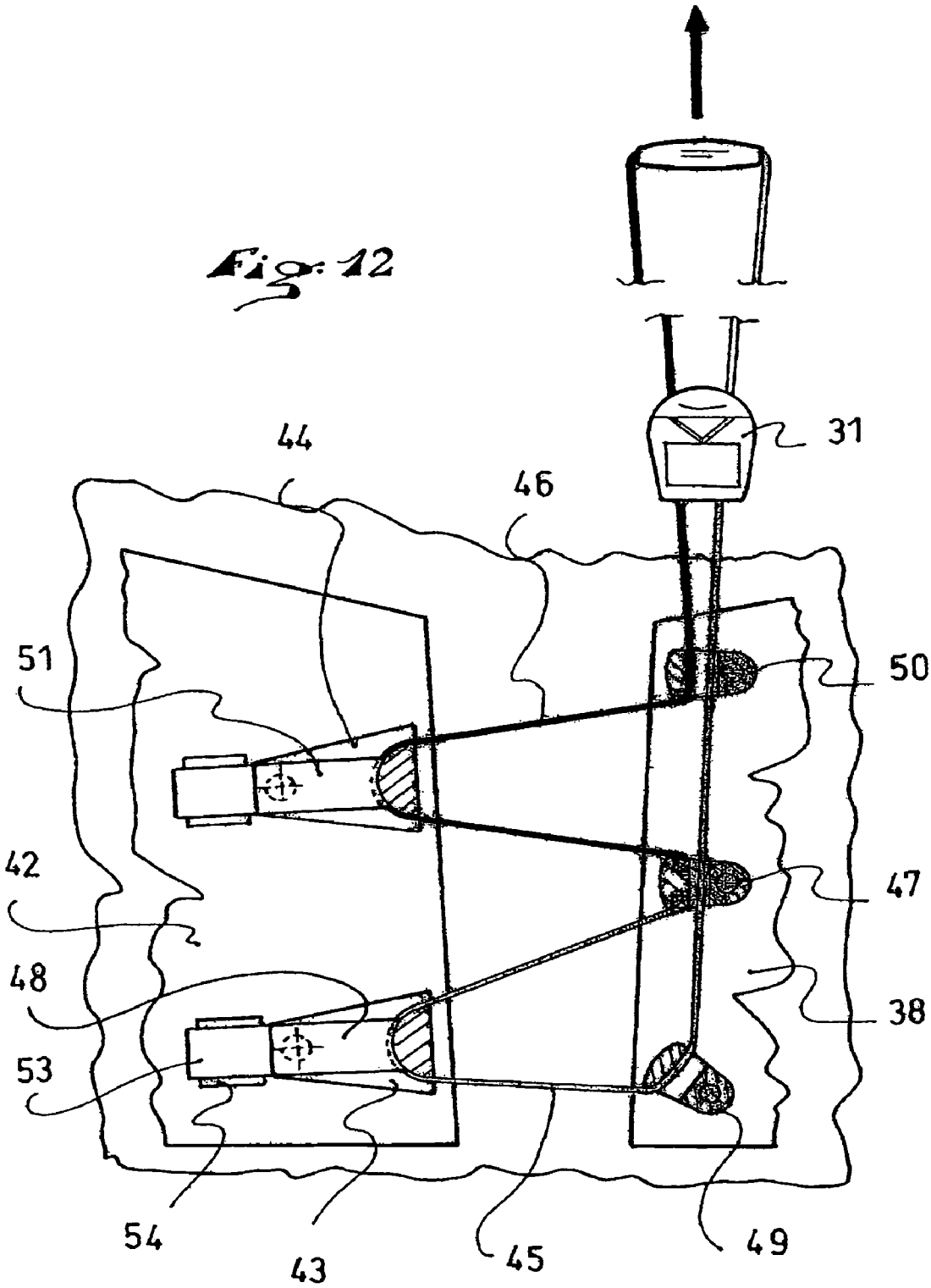
FIG. 12 is a schematic view showing the trajectory of the lace strands of the adjustment device.

FIG. 12 schematically shows the lacing assembly of the adjustment device. The first end of the forefoot lace 45 is fixed to the intermediate keeper 47. The path of the forefoot lace is then as follows: it passes along a forefoot guide 48, then in the forefoot keeper 49, the intermediate keeper 47 and, finally, the instep keeper 50. The second end of the forefoot lace 45 is received in a blocker 31 and extends to a manipulation member to be grasped by the skater and pulled in the direction of the arrow shown in FIG. 12.

The first end of the instep lace 46 is fixed on the intermediate keeper 47. The path of the instep lace 46 is then as follows: it passes along a guide 51, then in the instep keeper 50. The second end of the instep lace 46 is received in the blocker 31 and extends to the manipulation member.

The use of the skate according to the third embodiment is simple and intuitive. The user puts the skate in the open position by pivoting the central portion 37 about the pivot axis 41. In the open state, the central portion 37, or cover, is outside of the shod foot area of access to the skate sole. Therefore, the user can simply and intuitively position his/her foot, already shod with the shoe, on the sole. Then, in a single operation, the user tilts the central portion to the closed position.

Due to the forefoot lace guide 48 and the instep pull guide 51, respectively, the user ensures that the forefoot lace 45 and the instep lace 46 are engaged in the forefoot hook 43 and in the instep hook 44, respectively. Finally, a traction on the laces adjusts the central portion 37 to the user's morphology. The traction on the laces is maintained by means of the blocker 31. A stronger traction on the instep lace 46, with respect to that exerted on the forefoot lace 45, makes it possible to differentiate the instep tightening from that of the forefoot. Generally speaking, skaters prefer a more substantial instep tightening to that of the forefoot.

The differentiated instep/forefoot tightening does not constitute a limitation of the third embodiment of the invention, and the invention encompasses the use of a single lace strand ensuring adjustment of the retaining arrangement to the forefoot and to the instep.

To avoid an ill-timed disengagement of the forefoot lace 45 and of the forefoot hook 43, the forefoot guide 48 is part of an assembly equipped with a female attachment element 53 that interacts with a male attachment element 54, or vice versa, provided on the second panel 42. The female element 53 and the male element 54 can be either Velcro® bands or snap fasteners. A similar arrangement is provided for the forefoot guide 51.

Further in this regard, a comparison of FIG. 9, showing the retaining arrangement in the open state, and FIG. 11, showing the retaining arrangement in the closed state, it can be see that, in the open state, the forefoot and instep guides 48 and 51, and the assemblies of which they are parts, are not shown in FIG. 9, inasmuch as the forefoot and instep guides 48, 51, and their respective attachment elements 53, are carried by the laces 45, 46, which are blocked from view in FIG. 9. After the central portion 37 of the retaining arrangement is pivoted by the user about the axis 41 to the closed position, shown in FIG. 11, and after the laces are tightened (FIG. 12), the forefoot attachment elements 53, 54 and the instep attachment elements 53, 54 are engaged, thereby fixing the forefoot guide 48 and instep guide 51 in place.

The invention is not limited to the several particular embodiments that have been described herein by way of example, and the present application encompasses any equivalent embodiment within the scope of the claims.

LIST OF ELEMENTS skate frame 1
wheel 2
fitting portion 3
sole 4
heel stiffener 5
edge 6
collar 7
rivet 8
pad 9
shoe 10
cover 11
forefoot pad 12
instep pad 13
tongue 14
semi-rigid band 15
forefoot loop 16
forefoot flange 17
elastic band 18
lateral loop 19
instep flange 20
medial loop 21
notched strap 22
lever ratchet mechanism 23
flexible strap 24
lateral pad 25
medial pad 26
elastic panel 27
lacing 28
keeper 29
lace 30
blocker 31
end-piece 32
forefoot strap 33
instep strap 34
tongue 35
ratchet 36
central portion 37
first panel 38
lateral edge 39
medial edge 40
pivot axis 41
second panel 42
forefoot hook 43
instep hook 44
forefoot lace 45
instep lace 46
intermediate keeper 47
forefoot guide 48
forefoot keeper 49
instep keeper 50
instep guide 51
self-adhesive band 52
female attachment element 53
male attachment element 54

The invention claimed is:

1. A skate comprising:

a frame provided to receive a gliding member, said gliding member comprising a plurality of wheels or a blade for gliding on ice;

a sole adapted to support a user's shod foot;

a heel stiffener;

a foot retaining arrangement including a cover, said foot retaining arrangement being movable between an open state enabling insertion or removal of the user's foot, and a closed state enabling adjustment of said foot retaining arrangement around the user's foot, said foot retaining arrangement comprising:

an anchoring mechanism on a first side of the skate, said anchoring mechanism comprising a pivot zone about which said foot retaining arrangement is pivotal during movement of said foot retaining arrangement between the open and closed states;

in said open state, said cover being outside a path of movement of the user's shod foot to and from a supported position on said sole;

a fastening device on a second side of the skate, said fastening mechanism being adapted to keep said foot retaining arrangement in the closed state;

said first side of the skate being a medial side and the second side of the skate being a lateral side, or said first side of the skate being the lateral side and the second side of the skate being the medial side;

an adjustment device enabling adjustment of said foot retaining arrangement to the morphology of the user's foot.

2. A skate according to claim 1, wherein:

said anchoring mechanism includes a forefoot anchoring portion and an instep anchoring portion, each of said forefoot and instep anchoring portions comprising a pivot zone about which said foot retaining arrangement pivots during movement of said foot retaining arrangement between the open and closed states; and said fastening device includes a forefoot fastening portion and an instep fastening portion adapted to keep said foot retaining arrangement in the closed state.

3. A skate according to claim 1, wherein:

said fastening device includes a notched strap and a lever ratchet mechanism; and said adjustment device includes a flexible strap that runs on the cover along a Z-shaped path.

4. A skate according to claim 3, wherein:

said cover includes a forefoot pad and an instep pad; and said pads are connected to one another by a band.

5. A skate according to claim 1, wherein:

said foot retaining arrangement includes a lateral pad and a medial pad connected to one another by said adjustment device enabling adjustment of said retaining arrangement to the user's morphology.

6. A skate according to claim 4, wherein:

said adjustment device includes a lacing assembly comprising a plurality of lacing guides and a lace.

7. A skate according to claim 1, wherein:

said foot retaining arrangement includes a tongue adapted to ensure comfort continuity for the user's lower leg.

8. A skate according to claim 1, wherein:

said anchoring mechanism includes a first material panel capable of being folded along an axis that is substantially parallel to the longitudinal axis of the skate;

said fastening device includes a second panel equipped with at least one hook; and said foot retaining arrangement includes a central portion for insertion between said first panel and said second panel.

9. A skate according to claim 8, wherein:

said central portion and said first panel are fixed to one another by self-adhesive bands.

10. A skate according to claim 8, wherein:

said central portion is extended by a tongue.

11. A skate according to claim 1, wherein:

said adjustment device includes a first lace strand constituting a forefoot lace, and a second lace strand constituting an instep lace, said forefoot lace and said instep lace enabling forefoot/instep differentiated tightening.

12. A skate according to claim 1, wherein:

said cover includes a forefoot pad and an instep pad; and said pads are connected to one another by a band.

13. A skate according to claim 1, wherein:

in said open state, an entirety of said foot retaining arrangement, including said cover, is outside a path of movement of the user's shod foot to and from a supported position on said sole, without removing said foot retaining arrangement from the skate.

* * * * *